US008395098B2

(12) United States Patent
Pan et al.

(10) Patent No.: US 8,395,098 B2
(45) Date of Patent: Mar. 12, 2013

(54) INDUCTION COOKWARE

(75) Inventors: Chih-Jung Pan, Taipei County (TW); Shun-Yung Chang, Taipei (TW); Kuo-Liang Lee, Taipei (TW); Chun Horn Kuo, Taipei (TW); Ling-Chin Chao, Taipei County (TW)

(73) Assignee: Tsann Kuen Enterprise Co., Ltd., Taipei (TW)

( * ) Notice: Subject to any disclaimer, the term of this patent is extended or adjusted under 35 U.S.C. 154(b) by 673 days.

(21) Appl. No.: 12/617,119

(22) Filed: Nov. 12, 2009

(65) Prior Publication Data

US 2010/0116819 A1 May 13, 2010

(30) Foreign Application Priority Data

Nov. 12, 2008 (TW) ..... 97220272 U

(51) Int. Cl.
*H05B 6/12* (2006.01)

(52) U.S. Cl. ..... 219/620; 219/622; 219/624; 219/672

(58) Field of Classification Search ..... 219/620–627, 219/661–667, 672–676
See application file for complete search history.

(56) References Cited

FOREIGN PATENT DOCUMENTS

JP 07155251 A * 6/1995
JP 09289946 A * 11/1997
JP 2007282783 A * 11/2007

OTHER PUBLICATIONS

JP 2007-282783 A, Kogure et al., English translation, 8 pages, Nov. 2007.*
JP 07-155251 A, Tsuji, English translation, 8 pages, Jun. 1995.*
JP 09-289946 A, Hata, English translation, 8 pages, Nov. 1997.*

* cited by examiner

*Primary Examiner* — H. Jey Tsai
(74) *Attorney, Agent, or Firm* — Rabin & Berdo, P.C.

(57) ABSTRACT

An induction cookware comprising: a cooking body containing an inner pot inside, an insulation material disposed between the cooking body and the inner pot for maintaining the temperature of the inner pot. An induction coil is disposed in the bottom of the cooking body and with an extra magnetic field, the induction coil can generate AC current. The current flows through an electric heating tube connected to the bottom of the inner pot so as to heat the heating tube. Thereby, the heating tube directly transfer the heat to the inner pot for reducing the heat from transpiration. The structure of a cooking body with an inner pot inside can heat and slow cook the food inside the inner pot simultaneously, thus can add the delicious taste of the food and save the energy.

5 Claims, 4 Drawing Sheets

INDUCTION COOKWARE

FIELD OF THE INVENTION

The present invention relates to an induction cookware, and more particularly, to a cookware which cooks and stews food by heat produced by electromagnetic induction.

PRIOR ART

The slow cooker in prior art generally comprises an outer cooking pot and an outer cooking pot lid which are made of insulation material and coupled with each other; and an inner cooking pot and an inner cooking pot lid which are coupled with each other. In cooking operation, the food is put in the inner pot and the inner pot is heated to a cooking temperature by gas oven or electromagnetic oven, then the inner pot is put into the outer pot and covered by the outer pot lid. The food in the inner pot is maintained in a cooking temperature by the insulation effect of the outer pot and outer pot lid so as to slow cook the food.

However, the above mentioned slow cooker in prior art is slow in cooking the food by the insulation effect of the outer pot and outer pot lid. Due to the poor insulation effect of the insulation material, the heat loss is increased, thus the cooking temperature of the inner pot is decreased continuously, and the time of the cooking is increased. But the decreased temperature of the inner pot and the increased cooking time are easy to effect the food taste.

SUMMARY OF THE INVENTION

The primary object of the present invention is to provide an induction cookware, which generates heat by heat conduction and electromagnetic induction to heat the food and to slow cook the food so as to add the delicious taste of the food.

To achieve the abovementioned object, the present invention provides an induction cookware comprising: a cooking body having a bottom and a periphery wall extended upwardly from the periphery of said bottom, wherein said bottom and said periphery wall formed a containing groove; an inner pot disposed in said containing groove; an electric heating tube disposed in said containing groove, said electric heating tube fixedly connected to said inner pot; and an induction coil disposed in the bottom of said cooking body, and said induction coil electrically connected to the electric heating tube.

The present invention has the following advantages:

Firstly, the induction coil produces inducted current by extra magnetic field, the inducted current flow through said heating tube and heat the heating tube. The heating tube transfer the heat to the inner pot directly to cook and stew the food inside the inner pot, thus the heat loss can be decreased.

Secondly, the structure of a cooking body with an inner pot inside can heat the food inside the inner pot and slow cook the food inside the inner pot simultaneously, thus the food inside the inner pot can be continuously and uniformly cooked and stewed to add the delicious taste of the food.

Thirdly, by the heating way of heating the food inside the inner pot and slow cook the food inside the inner pot simultaneously, the heat efficiency is increased and the energy is saved.

The present invention will be apparent in its technical content and effect to be achieved after reading the detailed description of the preferred embodiment thereof in reference to the accompanying drawings.

Figure 1:
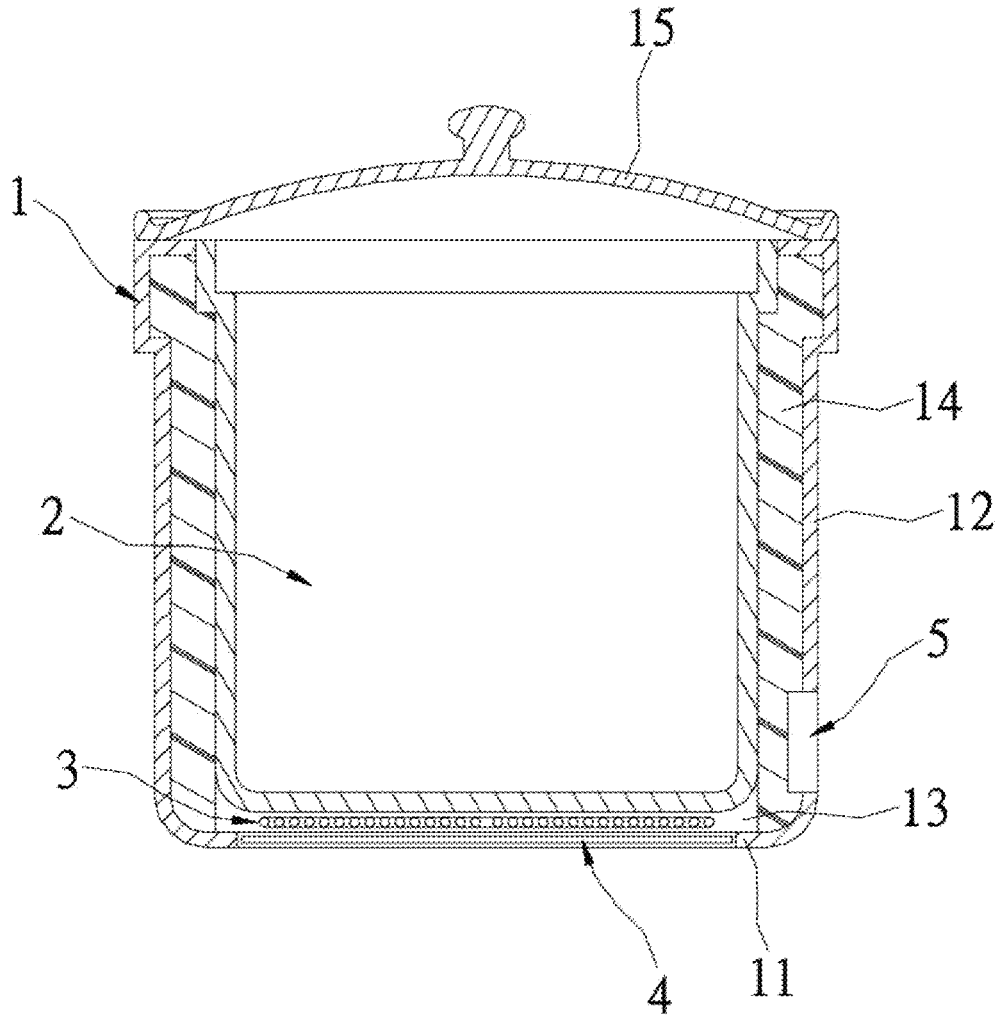
FIG. 1 is a sectional view of a preferred embodiment of the present invention.

| | |
|---|---|
| in these figures | |
| cooking body 1 | |
| bottom 11 | periphery wall 12 |
| handle 121 | containing groove 13 |
| insulation material 14 | lid 15 |
| inner pot 2 | |
| electric heating tube 3 | |
| induction coil 4 | |
| electric control module 5 | |
| RF reception and emission module 51 | |
| Temperature detecting circuit 52 | identification chip 53 |
| AC/DC power module 54 | |
| energy-storing circuit 55 | |
| electric platform 6 | |
| driving module 61 | |
| RF reception and emission module of the electric platform 62 | |
| Induction coil of the electric platform 63 | |
| AC power 64 | |

DETAILED DESCRIPTION OF THE PREFERRED EMBODIMENT

Figure 2:
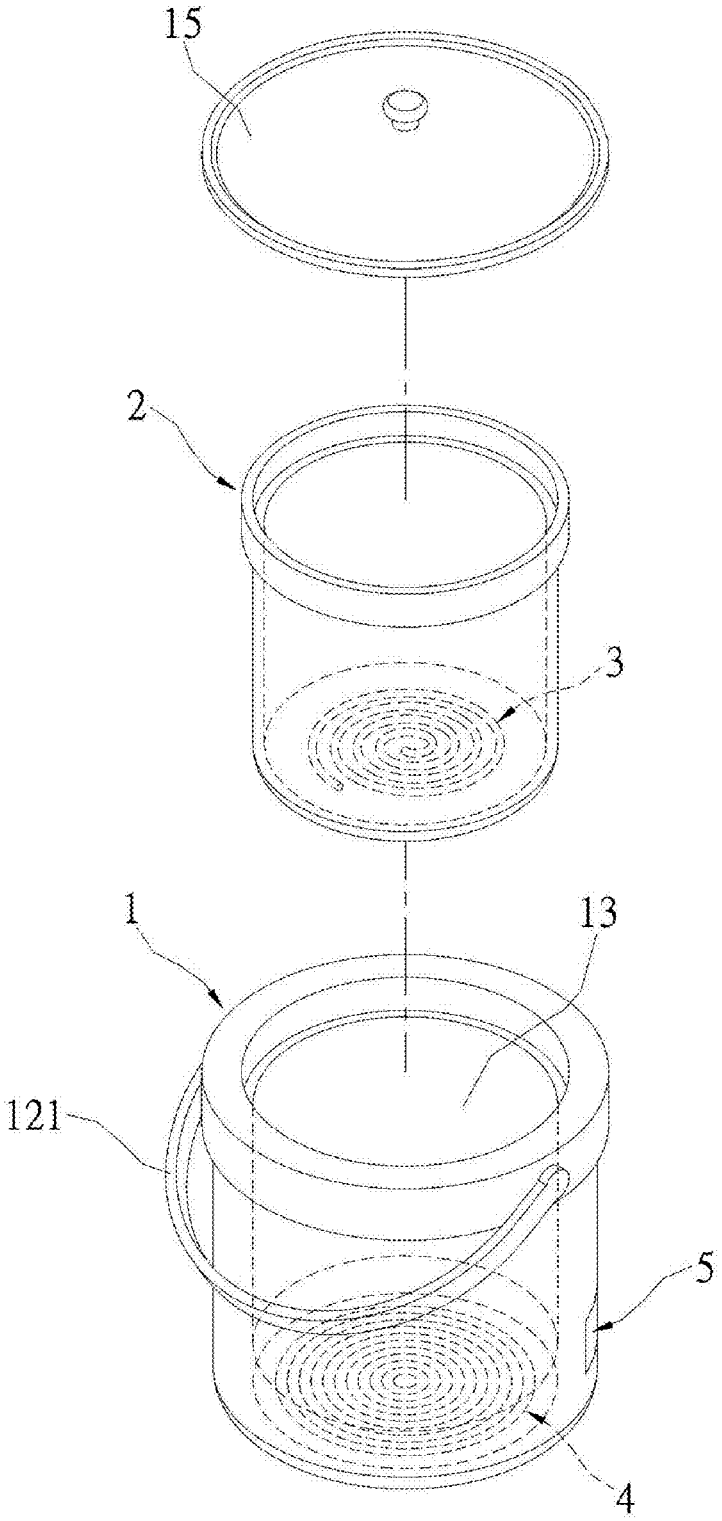
FIG. 2 is a perspective view of a preferred embodiment of the present invention.
Figure 3:
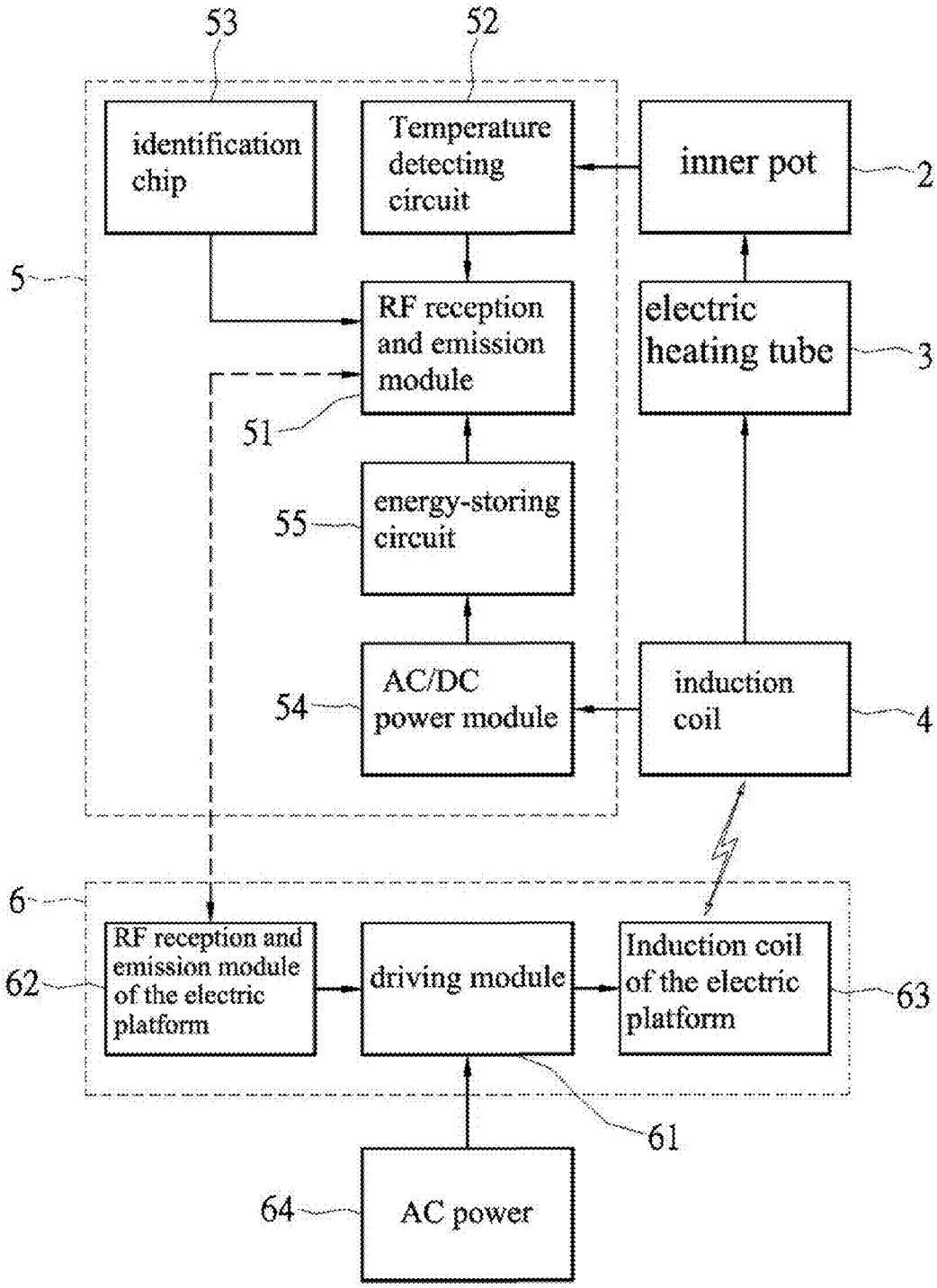
FIG. 3 is a block/schematic diagram of a preferred embodiment with an electric platform of the present invention.

Referring to FIG. 1, FIG. 2 and FIG. 3, the induction cookware of the present invention comprises: a cooking body 1 having a bottom 11 and a periphery wail 12 extended upwardly from the periphery of said bottom 11. The periphery wall 12 has a handle 121 on the outside, said bottom 11 and said periphery wall 12 formed a containing groove 13; an inner pot 2 is disposed in said containing groove 13 of the cooking body 1, which is used for placing food to be cooked and is fixedly disposed to the periphery wall 12 of the cooking body 1, an insulation material 14 or vacuum can be surround between the inner pot 2 and the periphery wall 12, so as to prevent the temperature of the inner pot 2 from decreasing, thus to achieve insulation effect.

An electric heating tube 3 can be connected to the outside or the bottom of the inner pot 2, in this embodiment the electric heating tube 3 is connected to the bottom of the inner pot 2 by rivet (shown in FIG. 1). The electric heating tube 3 is disposed in the containing groove 13, and the electric heating tube 3 is parallel connected to a secondary induction coil 4 disposed in the bottom 11 of the cooking body 1, the arrangement, the circle number and the material of the induction coil 4 can be set according to requirements. A lid 15 made of insulation material is disposed on the upper of the cooking body 1.

The induction coil 4 can produce induced current by extra magnetic field, the induced current flow though the electric heating tube 3 and heat the heating tube 3. The electric heating tube 3 transfers the heat to the inner pot 2 to make the temperature of the inner pot 2 rise to a cooking temperature. The electric heating tube 3 not only can be fixedly mounted to the bottom of the inner pot 2, but also can be fixedly connected to the outer sidewall of the inner pot 2 to increase the heat exchange area so as to let the heat to be conduct to the inner pot 2 more uniformly. While when the inner pot 2 get heat directly from the electric heating tube 3, by the structure of the inner pot 2 disposed inside the cooking body 1 and the lid 15, it can achieve heat preservation and reduce the decrease of the temperature of the inner pot 2, thus the heat efficiency is increased and the energy is saved. Moreover, by the heating way of heating the food inside the inner pot 2 and slow cooking the food inside the inner pot 2 simultaneously, the food inside the inner pot 2 can be continuously and uniformly cooked and stewed to add the delicious taste of the food.

The periphery wall 12 of the cooking body 1 further comprises an electric control module 5 (as is shown in FIG. 1), the electric control module 5 is well known in the art, so only the operating principle is described herein. The electric control module 5 has a RF reception and emission module 51 and a AC/DC power module 54 (as is shown in FIG. 3) The induced current generated by the induction coil 4 is transferred to direct current by the AC/DC power module 54, and the direct current is then output to an energy-storing circuit 55 which is the power source for the RF reception and emission module 51, the energy-storing circuit 55 also can store power for continuously providing power to the RF reception and emission module 51 to operate under the circumstance that there is not induced current. the RF reception and emission module 51 is also connected to a temperature detecting circuit 52 and an identification chip 53, the temperature detecting circuit 52 connected to the outside of the inner pot 2, thus the temperature detecting circuit 52 can detect the temperature of the inner pot 2 and output a temperature parameter to the RF reception and emission module 51. Moreover, the RF reception and emission module 51 also can receive the identifier generated by the identification chip 53.

Figure 4:
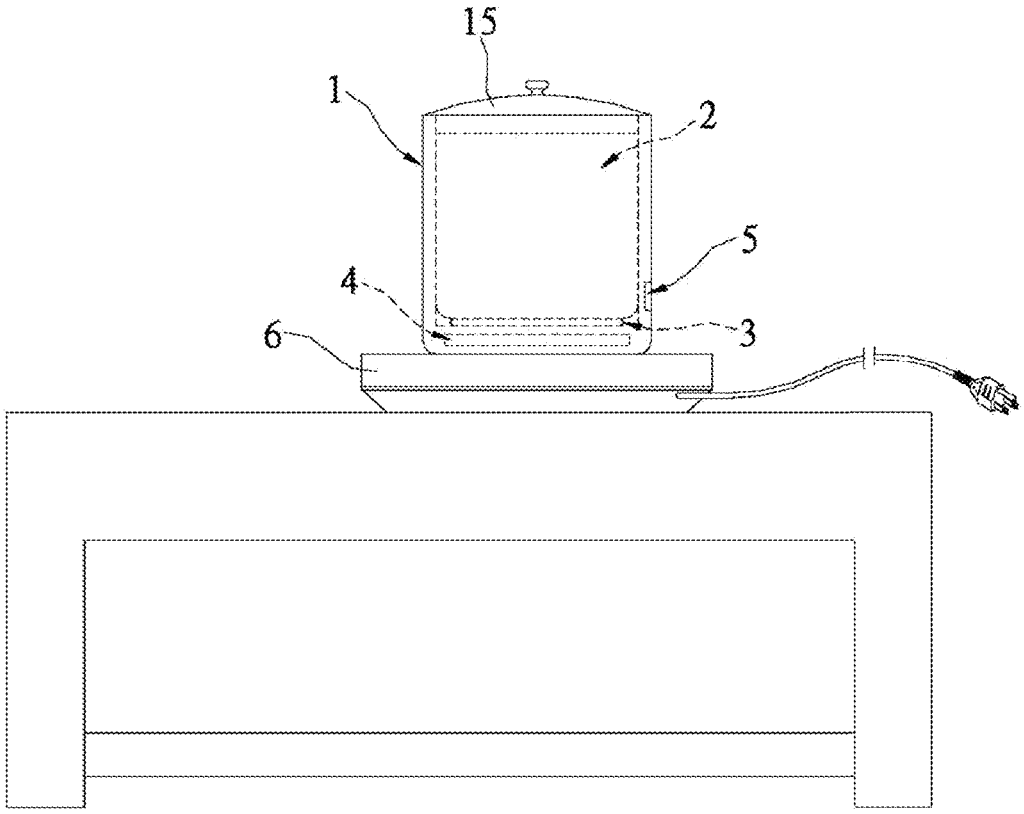
FIG. 4 illustrates the use state of the preferred embodiment cooperated with the electric platform of the present invention.

In use, the induction cookware of the present invention is placed on an electric platform 6 (as shown in FIG. 4), the electric platform 6 has a RF reception and emission module 62 (as shown in FIG. 3) which can transfer and receive information to the RF reception and emission module 51, said information comprises temperature parameter and identifier. After being received the temperature parameter and identifier, the RF reception and emission module 62 of the electric platform output an electrical signal to a driving module 61, the driving module 61 is connected to an extra power 64, and the driving module 61 can determinate to provide alternating current to a primary induction coil 63 of the electric platform or not according to the electrical signal.

When the induction coil 63 of the electric platform is electrified, time-varying electromagnetic field is generated, which make the electric heating tube to generate eddy current and heat up on one hand, and react with each other to the induction coil 4 to generate induced current on the other hand, the induced current of the induction coil 4 is output to the electric heating tube 3 to heat the resistance wire inside the electric heating tube 3. The electric heating tube 3 generates heat due to the induced current and induced magnetic field, and the heat is transferred to the inner pot 2 so that the temperature of the inner pot 2 is rise to a cooking temperature. However, the temperature detecting circuit 52 can transmit the temperature parameter to the RE reception and emission module 51, the RF reception and emission module 51 further transmit the temperature parameter to the RE reception and emission module 62 of the electric platform. After received the temperature, the RE reception and emission module 62 determinates to continuously provide alternating current to an induction coil 63 of the electric platform by the driving module 61. In the present embodiment, the minimum power is 100 W and the maximum power is 3000 W. the direct current is stored in the energy-storing circuit 55, which provides power for the electric control module 5 inside the induction cookware. Moreover, the electric control module 5 is only responsible for the transferring of the identifier and the temperature parameter, while the start and stop of the induction cookware is controlled by the electric platform 6.

In summary, place the induction cookware of the present invention on the electric platform 6 to use, the time-varying electromagnetic field of the induction coil 4 will react with that of the induction coil 63 of the electric platform to generate induced current, the induced current level can be determinate by the arrangement, the circle number and the material of the induction coil 4, thereby to provide a high power which is higher than the commercial power to improve the heating speed so as to shorten the time of cooking food. In addition, according to the temperature of the inner pot 2 in heating to determinate whether to continuously provide power, the heating temperature is automatically controlled in a temperature range in which the food is cooked to add the delicious taste of the food. Moreover, by the heating tube 3 transfer the heat to the inner pot 2 directly, and the insulation effect of the cooking body 1 and the lid 15, the heat efficiency is improved, the heat loss is decreased, thus the object of saving energy is achieved.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An induction cookware, comprising:

an electric platform connectable to a power source, and including a primary induction coil that is electrified to generate a time-varying electromagnetic field when said electric platform is connected to the power source;

a cooking body removably disposed on said electric platform, and having a bottom and a periphery wall extended upwardly from a periphery of said bottom, said bottom and said periphery wall forming a containing groove;

an inner pot disposed in said containing groove;

an electric heating tube disposed in said containing groove, said electric heating tube being fixedly connected to said inner pot, and having a resistance wire therein; and a secondary induction coil disposed at the bottom of said cooking body, said secondary induction coil being electrically connected to said electric heating tube;

wherein the electromagnetic field generated by the primary induction coil heats up said electric heating tube and causes said electric heating tube to generate eddy currents, and further causes said secondary induction coil to generate an induced current that is output to said electric heating tube to heat said resistance wire.

2. The induction cookware according to claim 1, wherein said cooking body further comprises an electric control module disposed with a temperature detecting circuit electrically connected to said inner pot, an identification chip, and an RF module electrically connected to said temperature detecting circuit and said identification chip, respectively.

3. The induction cookware according to claim 2, wherein said electric control module further comprises an AC/DC power module and an energy-storing circuit electrically connected to said RF module, one end of said AC/DC power module being electrically connected to said secondary induction coil, and the other end being electrically connected to said energy-storing circuit.

4. The induction cookware according to claim 3, wherein said cooking body further comprises an insulation material disposed inside the periphery wall of said cooking body.

5. The induction cookware according to claim 4, further comprising a lid corresponding to said cooking body.

* * * * *